US005906189A

United States Patent [19]

Mukai et al.

[11] Patent Number: 5,906,189

[45] Date of Patent: May 25, 1999

[54] EVAPORATIVE FUEL CONTROLLER FOR INTERNAL COMBUSTION ENGINE

[75] Inventors: Takeshi Mukai; Harumi Suzuki; Hitoshi Nakashima, all of Shizuoka-ken, Japan

[73] Assignee: Suzuki Motor Corporation, Shizuoka-ken, Japan

[21] Appl. No.: 09/016,116

[22] Filed: Jan. 30, 1998

[30] Foreign Application Priority Data

| | | | |
|---|---|---|---|
| Jan. 31, 1997 | [JP] | Japan | 9-032890 |
| Feb. 26, 1997 | [JP] | Japan | 9-042548 |
| Feb. 28, 1997 | [JP] | Japan | 9-061885 |

[51] Int. Cl.[6] ..... F02M 37/04

[52] U.S. Cl. ..... 123/519; 123/516; 123/198 D

[58] Field of Search ..... 123/519, 520, 123/521, 516, 518, 198 D

[56] References Cited

U.S. PATENT DOCUMENTS

| | | | |
|---|---|---|---|
| 3,884,204 | 5/1975 | Krautwurst | 123/519 |
| 4,024,848 | 5/1977 | Lee | 123/516 |
| 4,701,198 | 10/1987 | Uranishi | 123/519 |
| 4,852,761 | 8/1989 | Turner | 123/519 |
| 4,919,103 | 4/1990 | Ishiguro | 123/519 |
| 5,024,687 | 6/1991 | Waller | 123/519 |
| 5,269,279 | 12/1993 | Mukai et al. . | |
| 5,273,018 | 12/1993 | Suzuki . | |
| 5,297,527 | 3/1994 | Suzuki et al. . | |
| 5,297,528 | 3/1994 | Mukai . | |
| 5,335,638 | 8/1994 | Mukai . | |
| 5,375,579 | 12/1994 | Mukai . | |
| 5,411,007 | 5/1995 | Narita . | |
| 5,435,287 | 7/1995 | Mukai . | |
| 5,460,143 | 10/1995 | Narita . | |
| 5,546,913 | 8/1996 | Aoki . | |
| 5,579,742 | 12/1996 | Yamazaki et al. . | |
| 5,606,954 | 3/1997 | Yamazaki et al. . | |
| 5,647,333 | 7/1997 | Mukai . | |
| 5,647,334 | 7/1997 | Miller . | |
| 5,653,211 | 8/1997 | Ishikawa . | |
| 5,669,361 | 9/1997 | Weissinger et al. . | |
| 5,671,718 | 9/1997 | Curran et al. . | |

FOREIGN PATENT DOCUMENTS

| | | | |
|---|---|---|---|
| 53-27721 | 3/1978 | Japan . | |
| 0058143 | 4/1984 | Japan | 123/520 |
| 5-321774 | 12/1993 | Japan . | |
| 6-117336 | 4/1994 | Japan . | |
| 7-34989 | 2/1995 | Japan . | |
| 7-279788 | 10/1995 | Japan . | |

*Primary Examiner*—Carl S. Miller

*Attorney, Agent, or Firm*—Flynn, Thiel, Boutell & Tanis, P.C.

[57] ABSTRACT

An evaporative fuel controller for an internal combustion engine to prevent blow-off of fuel and/or outflow of emissions immediately after fuel is fed into a fuel tank, and to prevent a large quantity of evaporative fuel from flowing into a canister during engine operation. The controller includes a filler tube having a filler passage therein; a check valve for closing the filler passage immediately after the supply of fuel to the fuel tank; a refueling vapor control valve disposed on the fuel tank and communicating with the evaporation passage; a tank-side communication passage for communicating the refueling vapor control valve with the filler passage upstream of the check valve; a first communication passage for communicating the tank-side communication passage and the canister with one another; a first two-way check valve positioned in the first communication passage; a fuel cut valve located on the fuel tank; a second communication passage for communicating the fuel cut valve and the canister with one another; a second two-way check valve disposed in the second communication passage; a third communication passage bypassing the second two-way check valve and communicating with the second communication passage; and a two-way solenoid valve provided in the third communication passage.

4 Claims, 11 Drawing Sheets

EVAPORATIVE FUEL CONTROLLER FOR INTERNAL COMBUSTION ENGINE

FIELD OF THE INVENTION

This invention relates to an evaporative fuel controller for an internal combustion engine and, more particularly, to an improved evaporative fuel controller to prevent fuel from being blown out of a fuel tank immediately after the supply of fuel to the fuel tank, and further to prevent a large amount of evaporative fuel from flowing into a canister during operation of the engine.

This invention further relates to an evaporative fuel-collecting device for an engine and, more particularly, to an improved evaporative fuel-collecting device which is designed to realize purging from and loading into the canister without removal of a fuel tank, and to render evaporation piping larger in length, thereby accelerating fluidization of evaporation, and thus reducing the amount of absorption of evaporation into the canister.

This invention also relates to an evaporative emission control system usable with an evaporation system for a fuel tank of an engine which is disposed in an automobile and the like.

BACKGROUND OF THE INVENTION

In vehicles, evaporative fuel which leaks into the ambient air from a fuel tank, etc., is described as one of causes of air pollution because of the large content of hydrocarbons (HC). In addition, the evaporative fuel is responsible for a loss of fuel. Accordingly, various techniques are known as a prevention thereagainst, and one known evaporative fuel controller (an evaporation system) is representative of one such technique. In the known controller, evaporated fuel from a fuel tank is released (purged) from a canister during operation of an internal combustion engine so as to be supplied to the engine. The canister contains an absorbent such as activated carbon.

In some of the above-described evaporative fuel controllers, the canister is provided between an evaporation passage, which is communicated to the inside of the fuel tank, and a purge passage which is communicated to an intake system of the engine. A purge valve is disposed substantially midway along the purge passage for controlling a quantity of evaporative fuel to the intake system in accordance with an operating state of the engine. In addition, the fuel tank is provided with a filler tube which has a filler passage formed therein for pouring fuel into the fuel tank. Further, the evaporation passage is provided with a refueling vapor control valve for controlling the evaporative fuel to be fed from the fuel tank to the canister, and further for controlling the internal pressure of the fuel tank.

An example of such an evaporative fuel controller for an internal combustion engine is disclosed, e.g., in published Japanese Patent Application Laid-Open No. 7-279788. The controller as disclosed in this publication includes the following: a shutter disposed on the top of the filler tube, the shutter being opened by a fuel-feeding nozzle being inserted into the filler tube; a vent tube for communicating the canister with an upper portion of the inner space of the fuel tank; a fuel supercharge-preventing valve positioned at an end portion of the vent tube, which end portion extends over the inside of the fuel tank; a vent cut valve provided substantially midway along the line of the vent tube for closing the line of the vent tube in response to opening and closing actions of the shutter; and a clearance provided on a side wall of the filler tube, the clearance communicating with an upper portion of the inner space of the vent tube. The evaporative fuel controller thereby prevents stoic of the fuel supercharge-preventing valve without respective increases in dimensions and weight of the same valve, and further prevents a liquid level in the filler tube from rising in response to an increase in temperature inside the fuel tank.

With conventional types of evaporative fuel controllers for the internal combustion engine, there is an inconvenience in that the inner pressure of the fuel tank and the like may cause blow-off of fuel through a filler opening of the fuel tank, or outflow of fuel supply emissions to the ambient air, immediately after fuel is poured into the fuel tank by means of the fuel-feeding nozzle.

In addition, since the refueling vapor control valve is held open during operation of the engine, then a large amount of evaporated fuel in the fuel tank is caused to flow into the canister. This causes another inconvenience in that the function of the canister is deteriorated, thereby reducing the durability of the canister and thus reducing the running performance of the engine, with a concomitantly adverse influence on exhaust gases. As a result, controllers of this type have failed to meet new regulations on exhaust gases.

There is also known an evaporative fuel-collecting device representative of another technique for preventing loss of fuel evaporation. In the evaporative fuel-collecting device, evaporated fuel from a fuel tank is released (purged) from a canister during operation of an engine so as to be supplied to the engine. The canister contains an absorbent such as activated carbon.

An example of such an evaporative fuel-collecting device is disclosed, e.g., in published Japanese Patent Application Laid-Open No. 7-34989. The device as disclosed in this publication includes the following: a first conduit line, whereby evaporative fuel generated in the fuel tank is guided into a canister device; a first valve disposed substantially midway along the first conduit line, the first valve being set to an open state when the internal pressure of the fuel tank fails to meet a predetermined value; a second conduit line arranged parallel to the first conduit line in order to introduce the evaporative fuel into the canister device; and a second valve disposed substantially midway along the second conduit line, the second valve being set to an open state until the internal pressure of the fuel tank falls below the predetermined value when the aforesaid internal pressure exceeds the predetermined value during operation of the engine. In the canister device, a length of a passage inside the canister from a first opening of the first conduit line differs from that from a second opening of the second conduit line in order to accommodate increased regulations of evaporative fuel and a drop in the internal pressure of the fuel tank.

In some conventional types of the evaporative fuel-collecting devices, an engine is disposed in a vehicle, and the vehicle is provided with a fuel tank as well, with a fuel-collecting canister disposed on the top of the fuel tank.

However, with a vehicle having the fuel tank spaced apart from a vehicular underbody by a small clearance, as seen in automobiles, when the canister is to be disposed on the top of the fuel tank, then loading and purging of butane into and from the canister, as required by statutory requirements of the U.S. Evaporation Regulations, are impossible to practice through the use of the aforesaid clearance. This causes an inconvenience of requiring removal of the fuel tank, which is disadvantageous in view of practical use.

In addition, since evaporation piping communicated to the aforesaid canister cannot be made larger in length, there is another inconvenience in that nothing accelerates fluidization of evaporation, thereby making it impossible to reduce the amount of absorption of evaporation into the canister.

Further, in engines for automobiles, an evaporative emission control system is used in order to prevent green gases from diffusing to the outside. Such green gases vaporize from a liquid level of fuel in a fuel tank.

As illustrated in FIG. 13, in conventional types of evaporative emission control systems, such vaporized gases in a fuel tank are introduced into a canister "a", and are then absorbed by activated carbon (charcoal) "b", which is packed in the canister "a". Then, the absorbed gases are released from the canister "a" when the engine is run. Such released gases are guided into an engine intake passage "d" through a purge passage "c", and are then combusted in cylinders. A purge valve "e" is controlled to determine as to whether or not the vaporized gases are introduced into the engine intake passage "d". (Refer to published Japanese Patent Application Laid-Open No. 53-27721, for example). In this connection, in the canister "a", the activated carbon "b" is retained in a state of being sandwiched between upper and lower sheets of mesh "f".

However, in conventional types of evaporative emission control systems, a problem occurs with a bottom type of canister such as the canister "a" in FIG. 13, or a horizontal type of canister such as a canister "g" in FIG. 14, if the activated carbon "b" is spilled in the canister "a" or "e". More specifically, particles "h" of the activated carbon are caused to pass through the purge passage "c", with the result that the purge valve "e" is clogged up with the particles "h" (on the exit side of a valve disc). Accordingly, adverse affects such as abnormal operation of the engine or aggravation of exhaust gases are likely to bring about.

A further problem with the aforesaid types of canisters in FIGS. 13 and 14 is that these canisters are constructed so as to encourage the activated carbon particles to be drawn into the purge valve "e" by purge air if the activated carbon is spilled in the canister.

In order to obviate the above problems as encountered in the past, an object of the present invention is to provide an evaporative emission control system capable of ensuring that activated carbon particles in a canister are prevented from flowing into a purge valve.

SUMMARY OF THE INVENTION

In order to obviate the above-mentioned inconveniences, the present invention provides an evaporative fuel controller for an internal combustion engine, having a canister disposed between an evaporation passage communicated to the inside of a fuel tank and a purge passage communicated to an intake system of the engine, and a purge valve provided substantially midway along the purge passage for controlling an amount of evaporative fuel to the intake system in accordance with an operating state of the engine. The invention also includes: a filler tube having a filler passage formed therein for pouring fuel into the fuel tank; a check valve disposed in the filler tube for closing the filler passage immediately after the supply of fuel to the fuel tank; a refueling vapor control valve disposed on the fuel tank, the control valve communicating with the evaporation passage; a tank-side communication passage for communicating the refueling vapor control valve with the filler passage on the upstream side of the check valve; a first communication passage for communicating the tank-side communication passage and the canister with one another; a first two-way check valve positioned in the first communication passage; a fuel cut valve located on the fuel tank; a second communication passage for communicating the fuel cut valve and the canister with one another; a second two-way check valve disposed in the second communication passage; a third communication passage bypassing the second two-way check valve and communicating with the second communication passage; and a two-way solenoid valve provided in the third communication passage.

Pursuant to the present invention, the filler passage is closed by the check valve immediately after the fuel is supplied to the fuel tank, thereby preventing the fuel from being expelled out of the fuel tank through the filler opening, or preventing fuel supply emissions from flowing into the ambient air. Further, the refueling vapor control valve is closed during operation of the engine, thereby preventing the evaporative fuel in the fuel tank from entering the canister in large quantities. As a result, it is possible to satisfactorily retain the function of the canister, to improve the durability of the canister, to improve engine-running performance, and to prevent adverse influences on exhaust gases. Then, new regulations on exhaust gases can be met with a simple structure and low costs.

Furthermore, in order to obviate other above-mentioned inconveniences, the present invention provides an evaporative fuel-collecting device for an engine having a canister disposed between evaporation piping communicated to a fuel tank and purge piping communicated to an intake system of the engine, in which the canister absorbs and retains evaporative fuel during shutdown of the engine, the evaporative fuel being generated in the fuel tank and then introduced into the evaporation piping, and in which the absorbingly retained fuel is liberated from the canister during operation of the engine by means of the ambient air introduced through ambient air communication piping, thereby supplying such released fuel to the intake system of the engine through the purge piping, and in which a separator is disposed substantially midway along the evaporation piping, in which the canister is positioned on the top of the fuel tank, and wherein the evaporation piping is constructed to extend out of the canister and the separator is provided at a position adjacent one side of the fuel tank, in order to prevent purging from and loading into the canister without removal of the fuel tank when the separator is disposed substantially midway along the evaporation piping.

Pursuant to the present invention, when purging from and loading into the canister is conducted, then such purging and loading is realized without removal of the fuel tank. In addition, the evaporation piping is lengthened, thereby accelerating fluidization of evaporation, and thus reducing an amount of absorption of evaporation into the canister.

Further, in order to solve the aforesaid problems as associated with systems as shown in FIGS. 13 and 14, as discussed above, the present invention provides an evaporative emission control system having a purge valve disposed in an evaporative emission supply passage between a canister and an engine unit, the canister permitting evaporative emissions from a fuel tank to be absorbed by activated carbon in the canister, the purge valve being controlled to open and close, thereby controlling the supply of the evaporative emissions to the engine; a separator having a case body is disposed in the evaporative emission supply passage between the canister and the purge valve, the case body housing a plate and a resilient member, in which the plate can be opened and closed in a state of being opposed to the evaporative emission supply passage in a direction substantially perpendicular to the same passage, the plate including a filter member permeable by evaporative emissions, the filter member being capable to collect activated carbon, whereas the resilient member urges the plate in a closed direction, the resilient member having an urging force such as to permit the plate to be opened by a pressure differential between opposite sides thereof when the filter member is clogged with the activated carbon; and an activated carbon storage tank provided at a lower portion of the case body for storing the activated carbon which falls from the filter member when the plate portions are opened and closed by the aforesaid pressure differential, the activated carbon storage tank being formed with a takeoff aperture, through which such lodged carbon can be discharged to the outside.

Still further, the separator is positioned in the evaporative emission supply passage between the canister and the purge valve, and in the case body thereof, the plate is provided with the filter member. As a result, when the evaporative emissions are caused to flow through the case body, the activated carbon such as the activated carbon particles escaping from the canister can be collected in the case body.

Furthermore, the plate is urged in a closed direction thereof by means of the resilient member. The urging force of the resilient member is such as to permit the plate to be opened by a pressure differential between the upstream and downstream sides thereof when the filter member is clogged with the activated carbon. The filter member may become clogged by continued use thereof. As a result, when flow communication resistance exceeds a predetermined level, then the plate including the filter member provide a pressure differential between the upstream and downstream sides along the flow communicating direction of the evaporative emissions. Accordingly, the plate is moved and opened, whereby the evaporative emission supply passage to the purge valve can be prevented from being shut off.

At the lower portion of the case body, the activated carbon, which falls from the filter member when the plate is opened and closed by the pressure differential, can be stored in the activated carbon storage tank. The storage tank is constructed to allow such residing carbon to be discharged to the outside. As a result, timely discharging of the activated carbon is possible.

DETAILED DESCRIPTION

A first embodiment of the present invention will now be described in specific detail with reference to FIGS. 1–4 of the drawings.

Figure 1:
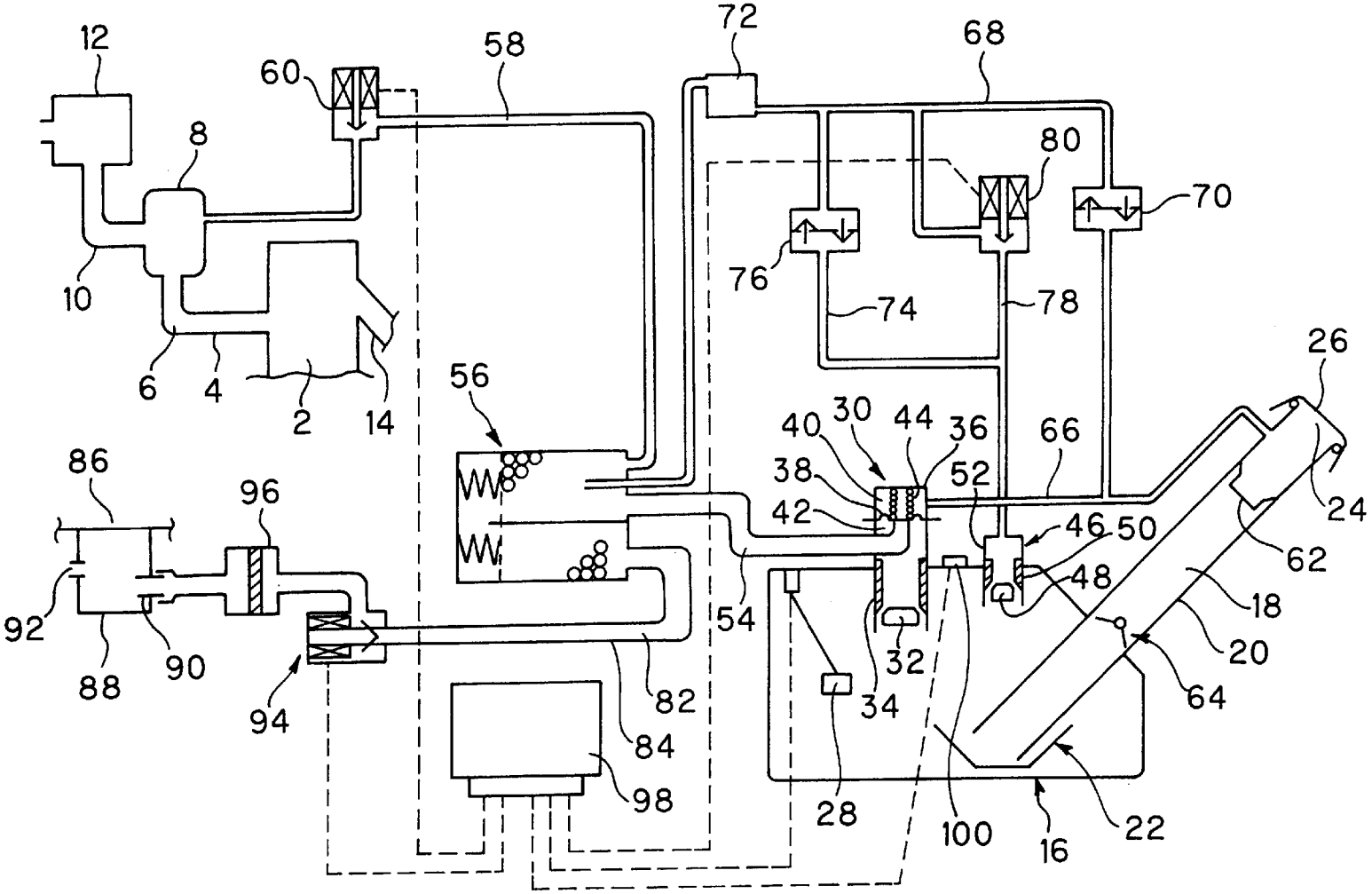
FIG. 1 is a diagrammatic view illustrating an evaporative fuel controller for an internal combustion engine according to the present invention.

In FIG. 1, reference numeral 2 denotes an internal combustion engine disposed in a vehicle (not shown); 4 an intake manifold; 6 an intake passage; 8 a surge tank; 10 an intake pipe; 12 an air cleaner; 14 an exhaust manifold; and 16 a fuel tank.

The fuel tank 16 is provided with a filler tube 20. The filler tube 20 has a filler passage 18 formed therethrough for pouring fuel into the fuel tank 16.

The filler tube 20 is of what is called a "liquid seal" type, in which one end of the tube 20 is immersed in the fuel within a liquid chamber body 22 contained in the fuel tank 16. More specifically, one end of the filler tube 20 is submerged in the fuel in order to preclude evaporative fuel from spilling through the other end of the tube 20, i.e., through a filler opening 24. The opening 24 of the filler tube 20 has a removable filler cap 26 disposed thereon. A level gauge 28 is positioned in the fuel tank 16.

The fuel tank 16 is provided with a refueling vapor control valve 30. The valve 30 includes the following: a first float valve 32 to be brought into upward and downward movements, depending upon the amount of fuel in the fuel tank 16; a first float seat 34, in which the first float valve 32 is brought against and away from the first float seat 34; a pressure-working chamber 40 and a passage communication chamber 42, both of which are formed and defined by a diaphragm 38 within a first housing 36; and springs 44 in the pressure-working chamber 40 for pressing the diaphragm 38 toward the passage communication chamber 42.

The fuel tank 16 is further provided with a fuel cut valve 46. The valve 46 includes the following: a second float valve 48 to be driven into upward and downward movements, depending upon the fuel amount; a second float seat 50, in which the second float valve 48 is urged against and away from the second float seat 50; and a second housing 52.

The refueling vapor control valve 30 is communicated to one end of an evaporation passage 54. Such one end of the passage 54 is opened and closed by movement of the diaphragm 38. A canister 56 is located at the other end of the evaporation passage 54. The canister 56 contains an absorbent such as activated carbon for absorbing and retaining the evaporative fuel.

Further, the canister 56 is communicated to one end of a vapor purge passage 58. The other end of the purge passage 58 is communicated to the surge tank 8 of the intake system. The purge passage 58 is provided with a purge valve 60 for regulating a purge amount (evaporative fuel quantity) from the canister 56 to the surge tank 8 in accordance with an operating state of the engine 2.

The filler passage 18 has a restrictor 62 and a check valve 64 arranged in turn away from the filler opening 24. The restrictor 62 is opened by a fuel-feeding nozzle (not shown) being inserted into the filler passage 18 during the supply of fuel to the fuel tank 16. The check valve 64 closes the filler passage 18 immediately after the supply of fuel to the tank 16 to prevent outward flow of fuel.

The pressure-working chamber 40 and the filler passage 18 on the upstream side of the restrictor 62 are communicated to one another through a tank-side communication passage 66. The tank-side communication passage 66 is communicated to one end of a first communication passage 68. The other end of the passage 68 is communicated to the canister 56. The first communication passage 68 is provided with a first two-way check valve 70 and a separator 72.

The fuel cut valve 46 is communicated to one end of a second communication passage 74. The other end of the passage 74 is communicated to the first communication passage 68 between the check valve 70 and the separator 72 in order to communicate with the canister 56. The second communication passage 74 is provided with a second two-way check valve 76.

In addition, one end of a third communication passage 78 is communicated to the second passage 74 in order to bypass the second check valve 76. The other end of the third passage 78 is communicated to the first communication passage 68 between the check valve 70 and the separator 72 in order to communicate with the canister 56. The third passage 78 is provided with a two-way solenoid valve 80.

The canister 56 is further communicated to one end of an ambient air-side tube 84. The tube 84 is formed with an ambient air-side passage 82 therein. The other end of the tube 84 is opened into a cross member 88 through a tube guide 90. The cross member 88 is a vehicle body frame member on the side of a vehicle body 86. The cross member 88 is formed with an ambient air-introducing opening 92. The ambient air-side passage 82 is provided with an air cut valve 94. An air filter 96 for removing air dust is positioned on the air upstream side of the air cut valve 94.

The level gauge 28, the purge valve 60, the two-way solenoid valve 80, and the air cut valve 94 are communicated to a control means 98 which in turn is communicated to a pressure sensor 100. The sensor 100 is positioned on the fuel tank 16 in order to detect the internal pressure of the tank 16.

Next, the operation of the invention according to FIGS. 1–4 will be described.

While the engine 2 is at rest, the first float valve 32 remains downwardly spaced apart from the first float seat 34 until the supply of fuel to the fuel tank 16 is started. In addition, the first two-way check valve 70 is closed, and the refueling vapor control valve 30 is closed. Further, the second float valve 48 is isolated from the second float seat 50; the second two-way check valve 76 provides opening and closing actions; and the control means 98 closes the two-way solenoid valve 80. As a result, evaporative fuel in the fuel tank 16 is guided through the second communication passage 74 to the canister 56.

Figure 2:
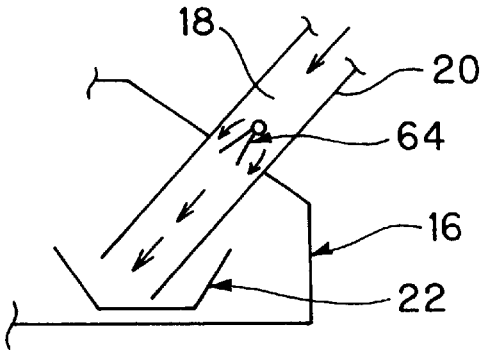
FIG. 2 is an illustration showing a flow of fuel during the supply of fuel to a fuel tank.

Referring now to FIG. 2, the restrictor 62 is shown opened when the fuel-feeding nozzle or gun is inserted into the filler passage 18 during the supply of fuel to the fuel tank 16 at the time of stoppage of the engine 2. Then, the pressure of the entering fuel opens the check valve 64, thereby supplying fuel to the fuel tank 16. At this time, the refueling vapor control valve 30 is opened with a rise in the internal pressure of the tank 16. In addition, the first and second two-way check valves 70, 76 and the solenoid valve 80 are closed. As a result, the evaporative fuel in the tank 16 is introduced to the canister through the evaporation passage 54.

Figure 3:
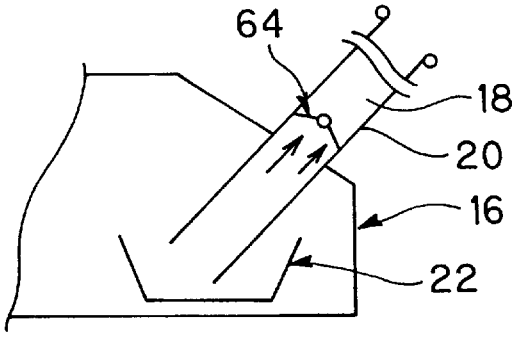
FIG. 3 is an illustration showing a state in which a check valve closes a filler passage immediately after the supply of fuel to the tank.

Turning now to FIG. 3, the check valve 64 is shown closed to shut off the filler passage 18 immediately after the supply of fuel to the tank 16 is terminated during stoppage of the engine 2. It is thus possible to prevent the fuel in the tank 16 from being blown out of the tank 16 through the filler opening 24. In addition, since the first two-way check valve 70 is closed, then emissions can be prevented from flowing outside through the filler opening 24. At this time, the first float valve 32 is positioned in contact with the first float seat 34. In addition, the first and second two-way check valves 70, 76 and the solenoid valve 80 are closed; the refueling vapor control valve 30 is closed.

When the engine 2 is initiated to run, immediately after the supply of fuel to the tank 16, then the first two-way check valve 70 is opened to a point where the atmospheric pressure substantially matches with the negative pressure of the intake pipe. In addition, the refueling vapor control valve 30 is closed; the two-way solenoid valve 80 is opened; and the two-way check valve 76 is closed. In this case, the evaporative fuel in the tank 16 is introduced into the canister 56 through the third communication passage 78.

Figure 4:
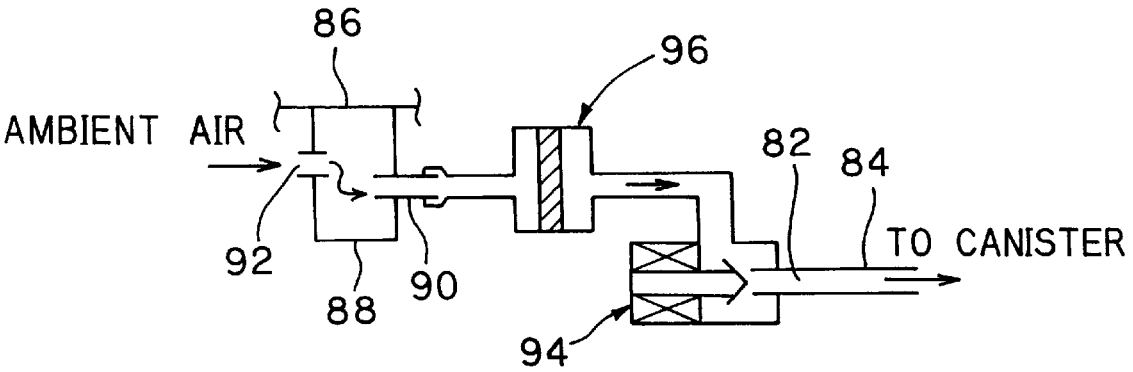
FIG. 4 is an illustration showing a flow of ambient air during operation of the engine.

Turning now to FIG. 4, the ambient air is shown introduced through the ambient air-introducing opening 92 of the cross member 88 during operation of the engine 2. The air filter 96 removes dust in the air, and then the clean air is supplied to the canister 56. At this time, the first and second float valves 32, 48 are drawn away from the float seats 34, 50; the first two-way check valve 70 is opened and closed; and the control valve 30 is thus closed. In addition, the second two-way check valve 76 is closed; and the solenoid valve 80 is opened by the control means 98. These valve positions cause the evaporative fuel in the tank 16 to be guided through the third communication passage 78.

As a result, the check valve 64 does not permit the fuel in the tank 16 to jet out of the tank 16 through the filler opening 24 immediately after the supply of fuel to the tank 16. In addition, fuel supply emissions can be prevented from flowing into the air through the filler opening 24.

Further, since the refueling vapor control valve 30 can be closed during operation of the engine 2, then the evaporative fuel in the tank 16 is prevented from entering the canister 56 in large quantities. As a result, it is possible to satisfactorily retain the function of the canister 56, to improve the durability of the canister 56, to enhance engine-running performance, and to prevent adverse influences on exhaust gases.

Furthermore, since the air filter 96 removes dust from the ambient air which is to be fed to the canister 56, then the air cut valve 96 and the canister 56 are prevented from being clogged up with dust. Consequently, the valve 96 and the canister 56 can provide improved durability.

As previously described, it is possible to prevent both accidental jets of fuel and outflows of fuel supply emissions. It is further possible to maintain components such as the canister 56 in a good condition. As a consequence, new restrains on exhaust can be accommodated with a simple structure and at low cost.

A further embodiment of the present invention will now be described with reference to FIGS. 5–8.

Figure 5:
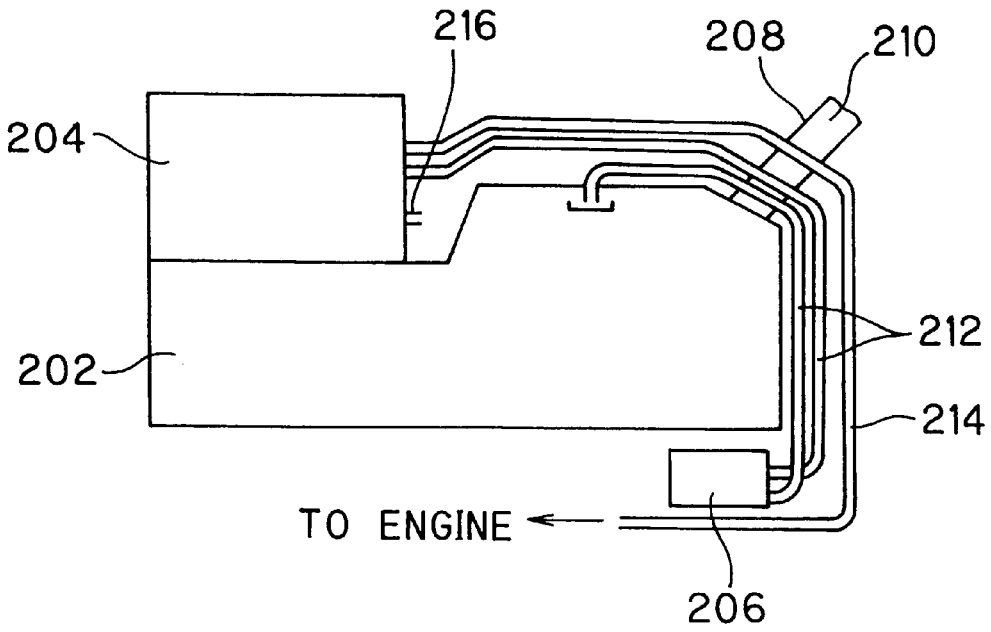
FIG. 5 is an enlarged diagrammatic view illustrating an evaporative fuel-collecting device for an engine in accordance with still a further embodiment of the present invention.
Figure 6:
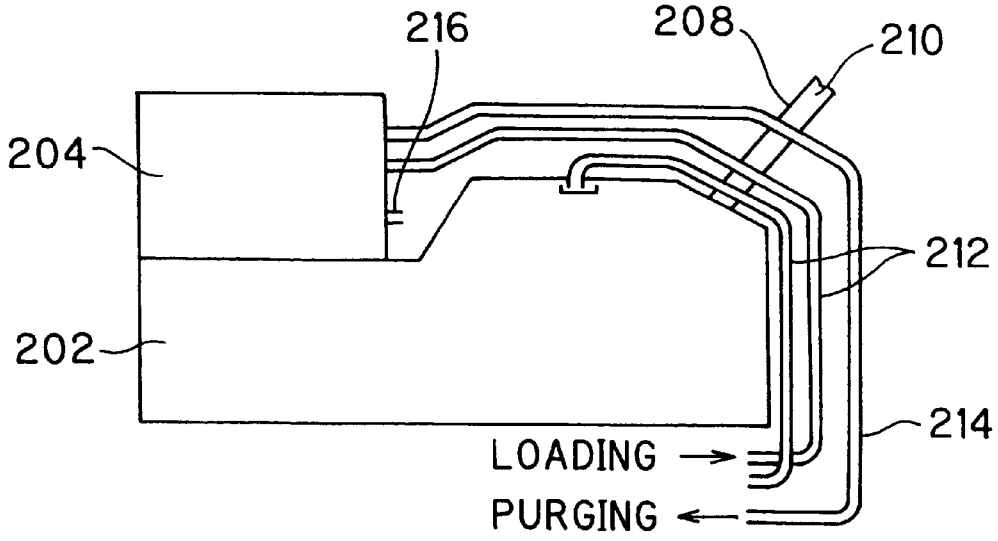
FIG. 6 is a view like FIG. 5 but showing a state in which a separator is removed from the collecting device.

FIGS. 5 and 6 illustrate a first variation. In FIG. 5, reference numeral 202 denotes a fuel tank; 204 a canister; and 206 a separator. The fuel tank 202 is disposed in a vehicle (not shown), together with an engine (not shown). The tank 202 contains fuel to be supplied to the engine. The fuel tank 202 is further provided with a fuel-feeding pipe (a filler hose) 208. A filler cap (not shown) is positioned on the outer end of the pipe 208. The fuel-feeding pipe 208 is formed with a fuel-feeding passage (a filler passage) 210.

In the fuel tank 202, the following conventional components (not shown) are provided: a fuel pump; a tank pressure sensor; a refueling vapor control valve and a float valve, in which the refueling vapor control valve includes a float valve body, and the float valve body is brought into upward and downward movements, depending upon an amount of fuel in the fuel tank; and a level gauge for detecting an amount of fuel in the tank.

Further, evaporation piping 212 is provided in communication with the fuel tank 202, while purge piping 214 is provided in communication with an intake system of the engine (not shown). The canister 204 is positioned between the evaporation piping 212 and the purge piping 214.

The canister 204 has the function to absorb and retain evaporative fuel during stoppage of the engine, which fuel is generated in the fuel tank 202, and is then introduced into the evaporation piping 212. The function of the canister 204 is further to release the absorbingly retained fuel from the canister 204 during operation of the engine by means of the ambient air introduced through ambient air communication piping 216, thereby supplying such evaporative fuel to the intake system of the engine through the purge piping 214.

A separator 206 is located substantially midway along the evaporation piping 212. As illustrated in FIG. 5, the canister 204 is provided on top of or above the fuel tank 202. More specifically, it is positioned on the top of the fuel tank 202 in the forward direction of the vehicle (the left side in FIG. 5).

Further, the evaporation piping 212 is constructed to extend out of the canister 204, and further to have the separator 206 provided at a position surrounding the fuel tank 202. Such an arrangement is to provide purging from and loading into the canister 204 without removal of the fuel tank 202 when the separator 206 is to be disposed substantially midway along the evaporation piping 212.

In greater detail, as illustrated in FIG. 5, the evaporation piping 212 extends from the canister 204 in the rearward direction of the vehicle (the right side in FIG. 5), and further extends over a rear portion of the fuel tank 202. Then, the evaporation piping 212 is provided with the separator 206 at a position around the other side of the tank 202, or rather, e.g., below the fuel tank 202.

Moreover, turning now to FIG. 6, the separator 206 located below the fuel tank 202 is shown removed from the evaporation piping 212. The evaporation piping 212 thereby serves as loading piping for the canister 204.

Similarly to the evaporation piping 212, the purge piping 214 extends from the canister 204 in the rearward direction of the vehicle (the right side in FIG. 5), and further extends over the rear portion of the fuel tank 202. Then, the purge piping 214 is provided so as to be directed in the forward direction of the vehicle (the left side in FIG. 5) and is disposed below the fuel tank 202.

Next, the operation of the invention of FIGS. 5–6 will be described.

The evaporative fuel produced in the fuel tank 202 is caused to flow past the separator 206 through the evaporation piping 212. The separator 206 is located below the fuel tank 202. Then, the evaporative fuel is drawn into the canister 204 through the evaporation piping 212. As a result, the evaporative fuel is absorbed and retained by the canister 204 which is positioned on the top of the fuel tank 202 in a direction toward the front of the vehicle (the left side in FIG. 5).

Further, when purging from and loading into the canister 204 is necessary, or when loading therein, e.g., is executed, then the piping of the separator 206 as located below the tank 202 of the vehicle (not shown) is disconnected from the evaporation piping 212 in order to permit the evaporation piping 212 to function as loading piping for the canister 204, as illustrated in FIG. 6. Thus, such loading is realized without removal of the fuel tank 202.

In brief, the purging from and loading into the canister 204 can be practiced without removal of the fuel tank 202. This is advantageous in view of practical use.

In addition, since the evaporation piping 212 can be lengthened, then wind caused by the traveling vehicle cools down the separator 206, thereby making it possible to promote fluidization of evaporation, and thus to reduce the amount of absorption of evaporation in the canister 204.

Further, since the separator 206 is positioned at a location adjacent one side of the fuel tank 202, i.e., below the fuel tank 202, then easy removal of the piping hose of separator 206 is achievable. This is advantageous in view of practical use.

Yet further, the removal of the piping hose of the separator 206, which is located under the tank 202, allows the evaporation piping 212 to serve as loading piping for the canister 204.

Figure 7:
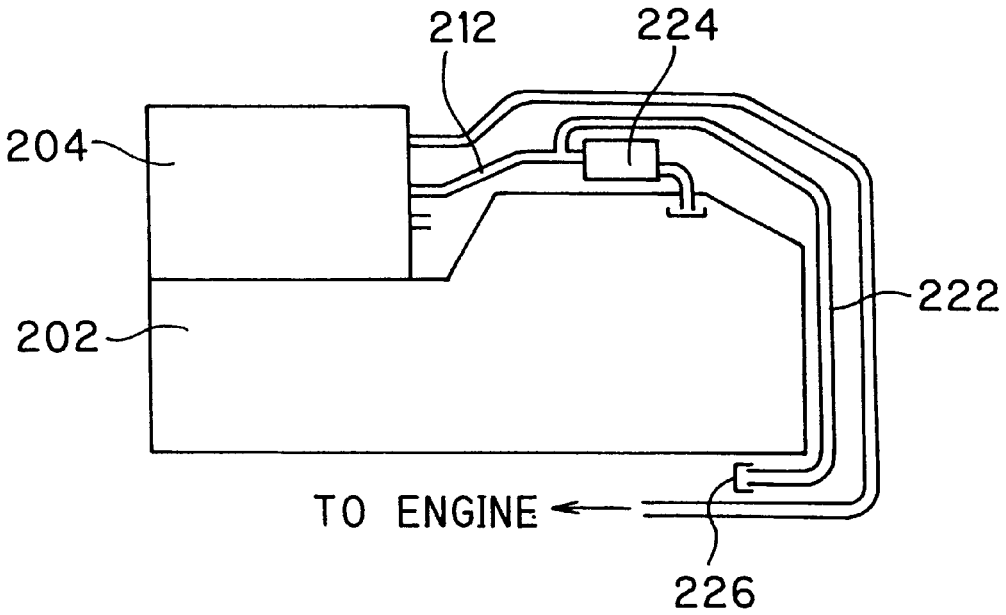
FIG. 7 is an enlarged diagrammatic view like FIG. 5 but showing a variation of the evaporative fuel-collecting device.

FIG. 7 illustrates a second variation of this embodiment. In the descriptions of this variation, the same reference characters are hereinafter used for features identical in function to those described with reference to the first variation of FIGS. 5–6.

The variation of FIG. 7 is characterized in that piping 222 for the single purpose of canister loading is provided and connected to the aforesaid evaporation piping 212.

More specifically, as illustrated in FIG. 7, a canister 204 is disposed on the top of the aforesaid fuel tank 202 in the forward direction of the vehicle (the left side in FIG. 7). Then, the evaporation piping 212 is brought out of the canister 204 in the direction toward the rear of the vehicle (the right side in FIG. 7). Further, the evaporation piping 212 is provided with a separator 224 at a location adjacent a side of the tank 202, or rather, e.g., on the top of the tank 202 in the direction toward the rear of the vehicle (the right side in FIG. 7).

In addition, the piping 222 for the single purpose of canister loading is provided, one end of which is connected to the evaporation piping 212. As shown in FIG. 7, the other end of the piping 222 extends over a rear portion of the fuel tank 202, and is then positioned below the tank 202.

Moreover, an opening and closing means 226 is provided at the other end of the piping 222 for opening and closing that particular end of the piping 222. Accordingly, when loading into the canister 204 is to be executed, then the means 226 opens the other end of the piping 222.

Thus, the purging from and loading into the canister 204 is achievable without removal of the fuel tank 202. Similarly to the first variation, this is advantageous in view of practical use.

In addition, the piping 222 for the single purpose of canister loading is provided, whose one end is communicated to the evaporation piping 212, while the other end of the piping 222 is positioned below the fuel tank 202; consequently, easy loading in the canister 204 is possible to practice by the cap means 226 being caused to open and close the other end of the piping 222 which is located under the fuel tank 202, even when the separator 224 is located at a position around the tank 202, i.e., on the top of the fuel tank 202 in the rearward direction of the vehicle (the right side in FIG. 7). This is advantageous in view of practical use.

Figure 8:
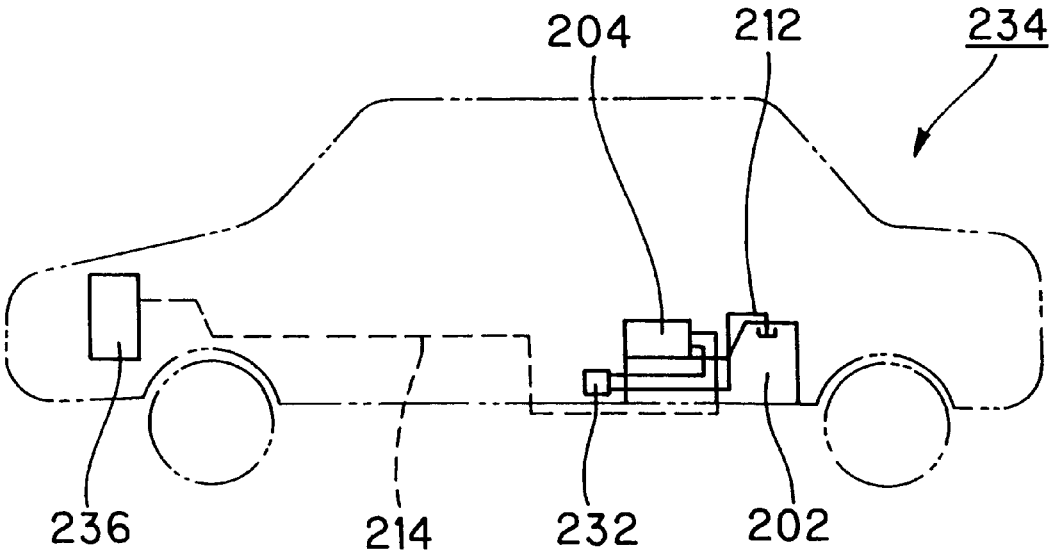
FIG. 8 is a diagrammatic view illustrating an evaporative fuel-collecting device for an engine disposed in a vehicle and showing a further variation thereof.

FIG. 8 illustrates a third variation of this embodiment. This third variation is characterized in that a separator 232 is positioned at a location adjacent the fuel tank 202, or rather, e.g., on one side of the fuel tank 202 in the direction toward the front of the vehicle (the left side in FIG. 8).

More specifically, as shown in FIG. 8, an engine 236 and the fuel tank 202 are disposed in forward and rearward sections of a vehicle 234, respectively. A canister 204 is provided on the top of the fuel tank 202 toward the front of the vehicle (the left side in FIG. 8).

In addition, evaporation piping 212 is provided for communicating the fuel tank 202 and the canister 204 with one another, while purge piping 214 is provided for communicating an intake system of the engine 236 with the canister 204.

Further, as illustrated in FIG. 8, when a separator 232 is to be disposed substantially midway along the evaporation piping 212, then the separator 232 is positioned adjacent one side of the fuel tank 202 in the forward direction of the vehicle (the left side in FIG. 8).

As a result, the purging from and loading into the canister 204 can be provided without removal of the fuel tank 202.

In addition, since the evaporation piping 212 can be made larger in length, then wind caused by the traveling vehicle cools down the separator 232, similarly to the first variation. As a result, it is possible to promote fluidization of evaporation, and thus to reduce the amount of absorption of evaporation in the canister 204.

Further, since the separator 232 is positioned at a location adjacent the fuel tank 202, i.e., on one side of the fuel tank 202 in the forward direction of the vehicle (the left side in FIG. 8), then easy removal of the piping hose of the separator 232 is achievable, similarly to the first variation.

Yet further, similarly to the first variation, the removal of the piping hose of the separator 232, which is located adjacent the tank 202, allows the evaporation piping 212 to function as loading piping for the canister 204.

A still further embodiment of the present invention will now be described with reference to FIGS. 9–12.

Figure 9:
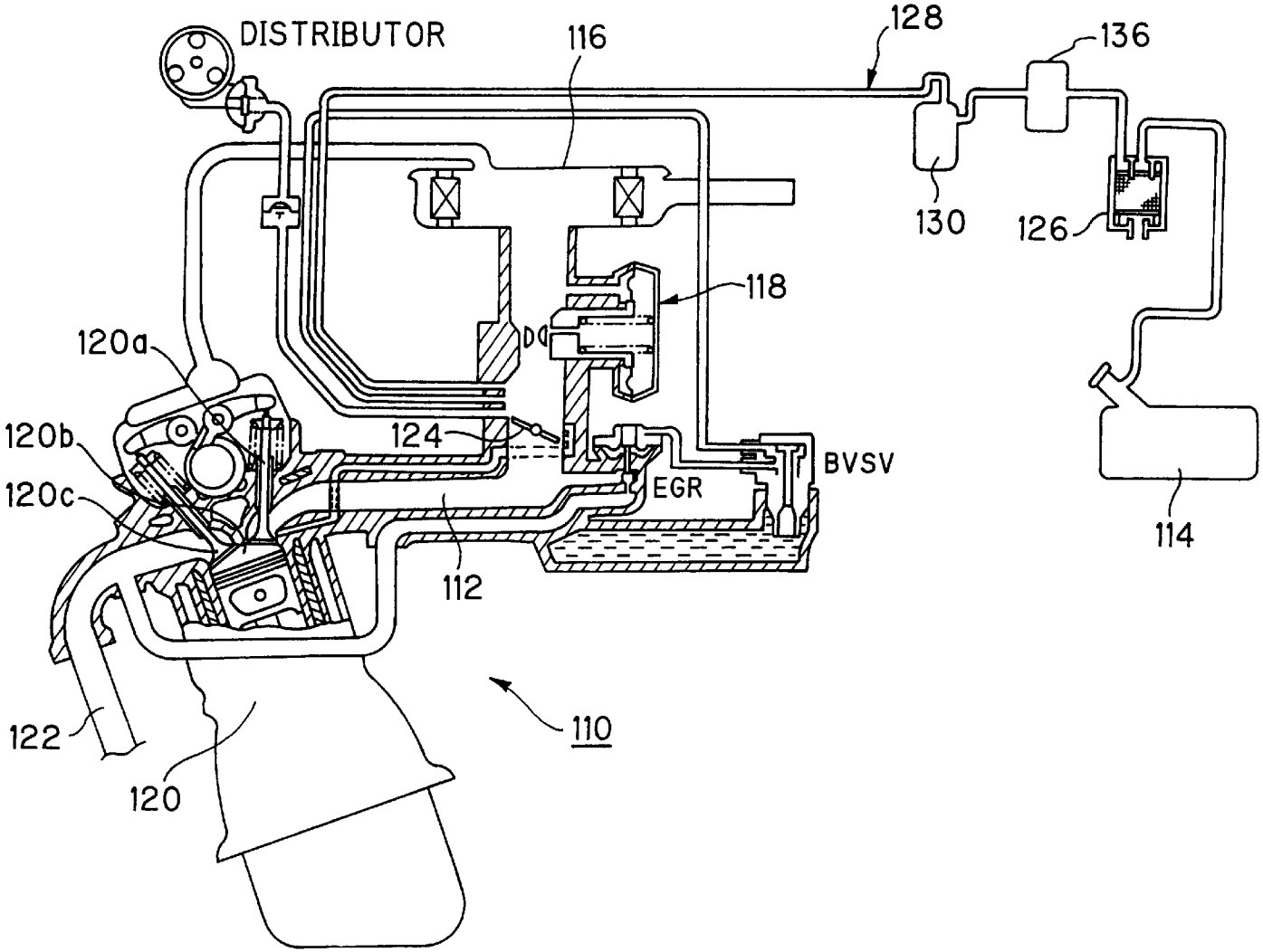
FIG. 9 is an explanatory diagrammatic illustration showing an example of an engine provided with an evaporative emission control system pursuant to a further embodiment of the present invention.

As illustrated in FIG. 9, this embodiment provides an evaporative emission control system associated with an evaporation system for supplying evaporative emissions from the inside of a fuel tank 114 to an air intake passage 112 of a four-cycle engine arrangement 110.

In the intake passage 112, clean suction air flowing from an air cleaner 116 is passed through a carburetor 118 in which the suction air is turned into an air-fuel mixture. The mixture is then caused to flow into a combustion chamber 120*b* of an engine 120 through an intake valve 120*a*. Exhaust gases produced after combustion are discharged into an exhaust passage 122 through an exhaust valve 120*c*.

In the intake passage 112, a throttle valve 124 is disposed on the downstream side of the carburetor 118.

The evaporative emission control system has a purge valve 130 disposed in an evaporative emission supply passage 128 between a canister 126 and the engine 110. In the canister 126, evaporative emissions from the fuel tank 114 are absorbed by activated carbon. The purge valve 130 is controlled to open and close, thereby controlling the supply of the aforesaid evaporative emissions to the engine 110 from the canister 126.

Figure 10:
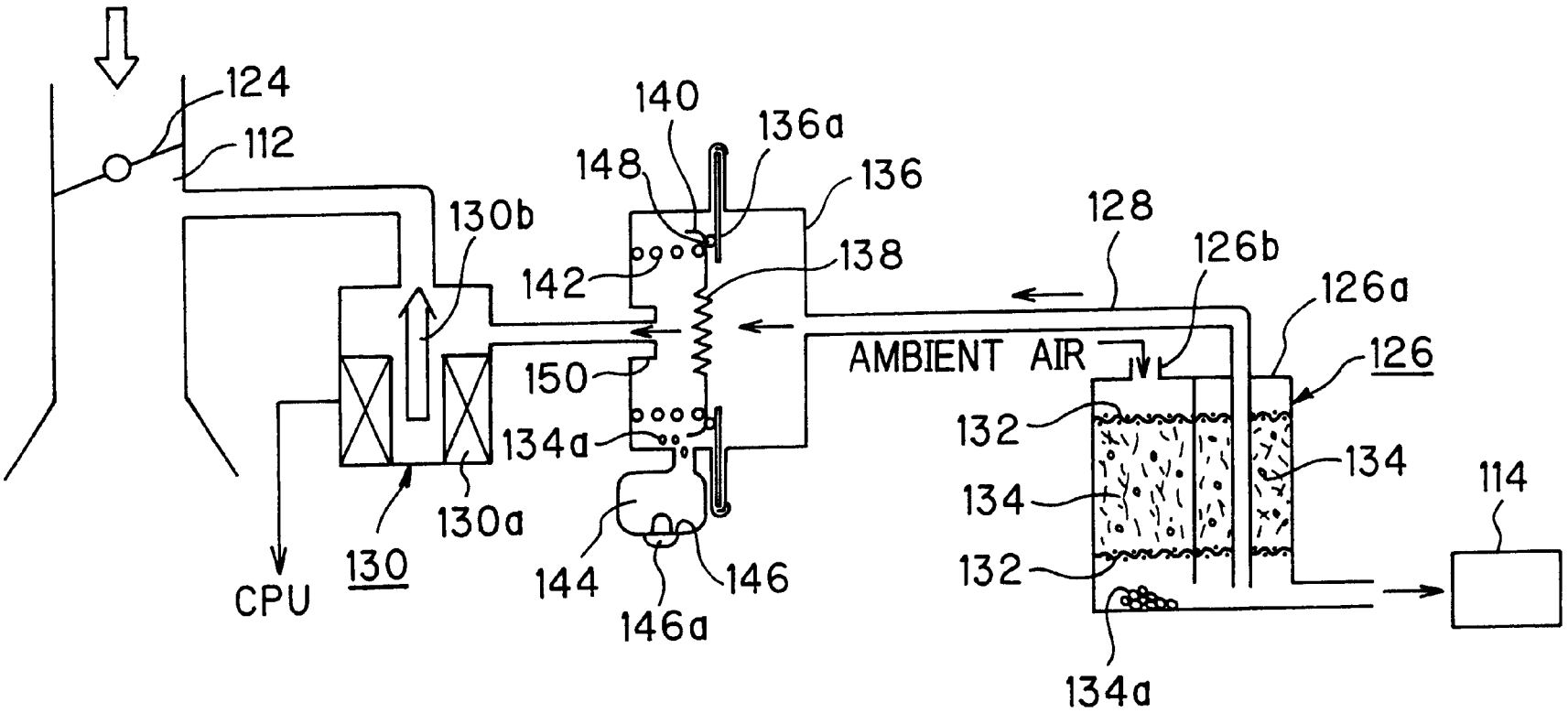
FIG. 10 is an explanatory illustration showing the aforesaid evaporative emission control system of FIG. 9.

More specifically, the canister 126 is of a bottom type, as seen from FIG. 10, in which activated carbon 134 is accommodated in a case 126*a*. The activated carbon 134 is interposed between upper and lower sheets of mesh 132. The canister 126 is open to the atmosphere through an upper opening 126*b*. The evaporative emissions from the fuel tank 114 are introduced into a lower portion of the case 126*a*. The evaporative emission supply passage 128 is connected to the lower portion of the case 126*a*.

In the purge valve 130, a solenoid 130*a* actuates a valve body 130*b* in response to a driving signal from an electronic control central processing unit (CPU) (not shown), thereby opening and closing the purge valve 130. When the engine 120 ceases operation, then the purge valve 130 is closed to leave the evaporative emissions absorbed by the activated carbon in the canister 126. When the engine 120 is run, then the purge valve 130 is opened to supply the evaporative emissions to the engine 120.

With continued reference to FIGS. 9 and 10, a separator having a hollow case or body 136 is shown positioned in the evaporative emission supply passage 128 between the canister 126 and the purge valve 130.

In the body 136, a plate 140 and springs 142 (the latter being an example of a resilient member) are provided. The plate 140 extends substantially perpendicular to the flow direction of passage 128 and can be moved between opened and closed positions in the direction of the passage 128. The plate 140 mounts a filter member 138 which is permeable by the evaporative emissions, and which can collect the activated carbon 134. The filter 138 extends over a central opening formed through the plate 140. The spring 142 extends between the plate 140 and a downstream wall of the body 136 and urges the plate 140 in a closing direction. The spring 142 has an urging force such as to permit the plate 140 to be opened by a pressure differential between the right and left (i.e. opposite) sides thereof when the filter member 138 is clogged with activated carbon particles 134*a* which escape from the canister 126.

Further, an activated carbon storage tank 144 is provided at a lower portion of the body 136. The storage tank 144 stores the activated carbon particles 134*a* which fall from the filter member 138 when the plate 140 is opened and closed by the above pressure differential. The carbon storage tank 144 is formed with an opening or aperture 146 in the bottom thereof through which particles 134*a* can be discharged from the storage tank 144. The aperture 146 has a grommet 146*a* fittingly secured thereto. The grommet 146*a* is made from a resilient body such as rubber. The grommet 146*a* can be pulled out of the aperture 146, whereby the carbon particles 134*a* are removable from the storage tank 144.

The body 136 has an annular wall portion 136*a* formed therein. The wall portion 136*a* protrudes inwardly into the hollow interior of the body 136. The wall portion 136*a* has a large opening therethrough at a central portion thereof. Peripheral edges of the plate 140 urged by the spring 142 toward the upstream flowing direction of the evaporative emissions is caused to strike against the wall portion 136*a*, thereby restricting further upstream movement of the plate portions 140 and defining a closed position.

A sealing member such as an elastic O-ring 148 is mounted on the downstream side of the wall portion 136*a* in surrounding relation to the central opening so as to abut the plate 140 in order to maintain a gas tight engagement therewith.

The body 136 has an annular protrusion 150 formed therein as an outlet of the evaporative emissions. The protrusion 150 is located around a portion of the body 136 at which the evaporative emission supply passage 128 is connected to the body 136. The protrusion 150 extends in an inward direction of the case body 136. The protrusion 150 serves as an embankment or shroud. As a result, the activated carbon particles 134*a* residing in the case body 136 are prevented from flowing into the downstream portion of the evaporative emission supply passage 128.

In the evaporative emission control system pursuant to the above-described embodiment, while the engine 110 is at rest, the purge valve 130 remains closed. At this time, the activated carbon 134 absorbs the evaporative emissions from the fuel tank 114.

Meanwhile, while the engine 110 is running, the purge valve 130 is opened, whereby the evaporative emissions absorbed by the canister 126 is caused to flow into the body 136. Now, assume that the activated carbon 134 is spilled (the activated carbon particles 134*a*) in the canister 126. Then, in the body 136, the evaporative emissions penetrate through the filter member 138. Thereafter, the evaporative emissions pass through the purge valve 130, and then flow into the intake passage 112. At this time, even if the carbon particles 134*a* are drawn toward the purge valve 130 in the passage 128 in a state of floating on a stream of evaporative emissions from the canister 126, then the carbon particles 134*a* are caught by the filter member 138 as the evaporative emissions flow through the body 136. As a result, the particles 134*a* are not moved into the purge valve 130.

Figure 11:
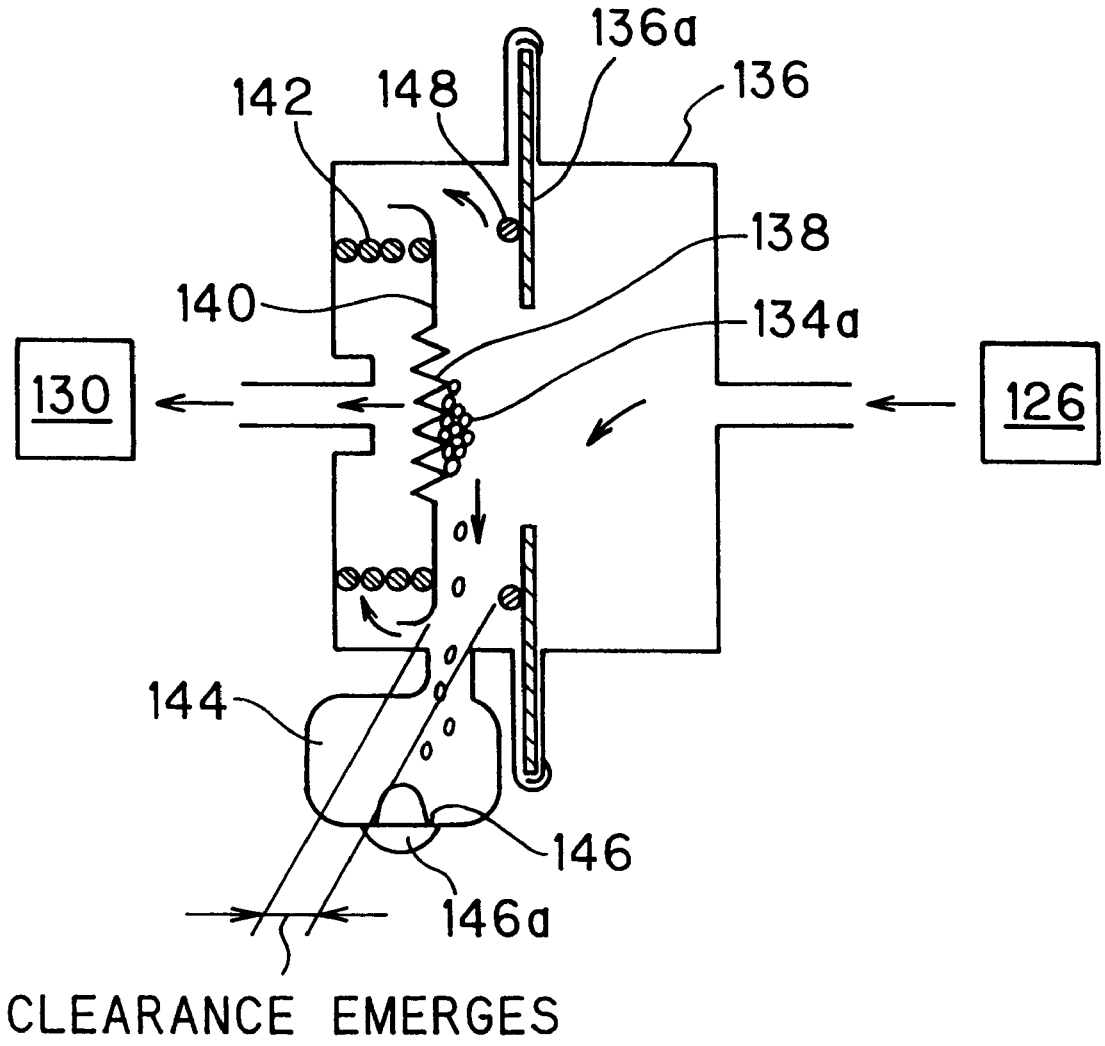
FIG. 11 is an explanatory illustration showing movement in FIG. 10.

The filter member 138 may become clogged with particles by continuing use thereof. As a result, when flow communication resistance exceeds a predetermined level, then the plate member 140 including the filter member 138 provide a pressure differential between the right and left sides of the plate portion 140 along the flow communicating direction of the evaporative emissions. As illustrated in FIG. 11, when such pressure differential overcomes the urging force of the spring 142, then the plate 140 is moved in opposition to the urging force of the spring 142, thereby providing a clearance between the plate 140 and the annular wall 136*a*. Thus, the evaporative emission supply passage from the canister 126 to the purge valve 130 is prevented from being closed.

In addition, the plate 140 is caused to vibrate or oscillate in the flow direction of the evaporative emissions (i.e., a back and forth motion). Such vibration causes the particles 134*a*, which clog the filter member 138, to be shaken off the filter member 138 whereby the particles 134*a* fall downwardly into the storage tank 144 at the lower portion of the body 136. Such particles 134*a* can be discharged to the outside by the grommet 146*a* being removed from the takeoff aperture 146.

As previously described, pursuant to the present invention, the filter member 138 can prevent the activated carbon particles 134*a* from penetrating into the purge valve 130 though the evaporative emission supply passage 128. Even when the filter member 138 is blocked with the activated carbon particles 134*a*, the particles 134*a* can be shaken off the filter member 138. As a result, the performance of the filter member 138 remains constant. Thus, such an inconvenience as damage to a sealing portion of the purge valve 130 can reliably be prevented, which otherwise would occur when the activated carbon particles pass into the purge valve 130.

Figure 12:
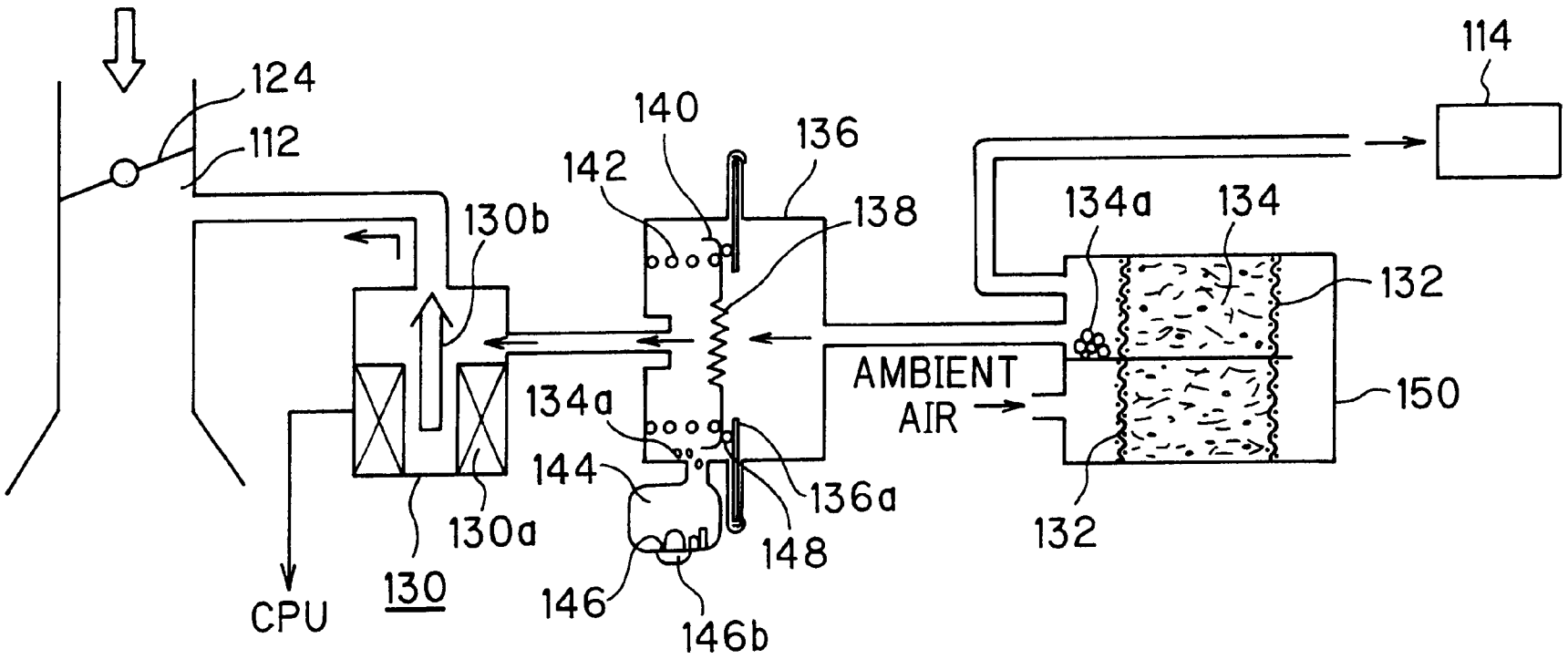
FIG. 12 is an explanatory illustration similar to FIG. 10 but showing a variation of the evaporative emission control system.
Figure 13:
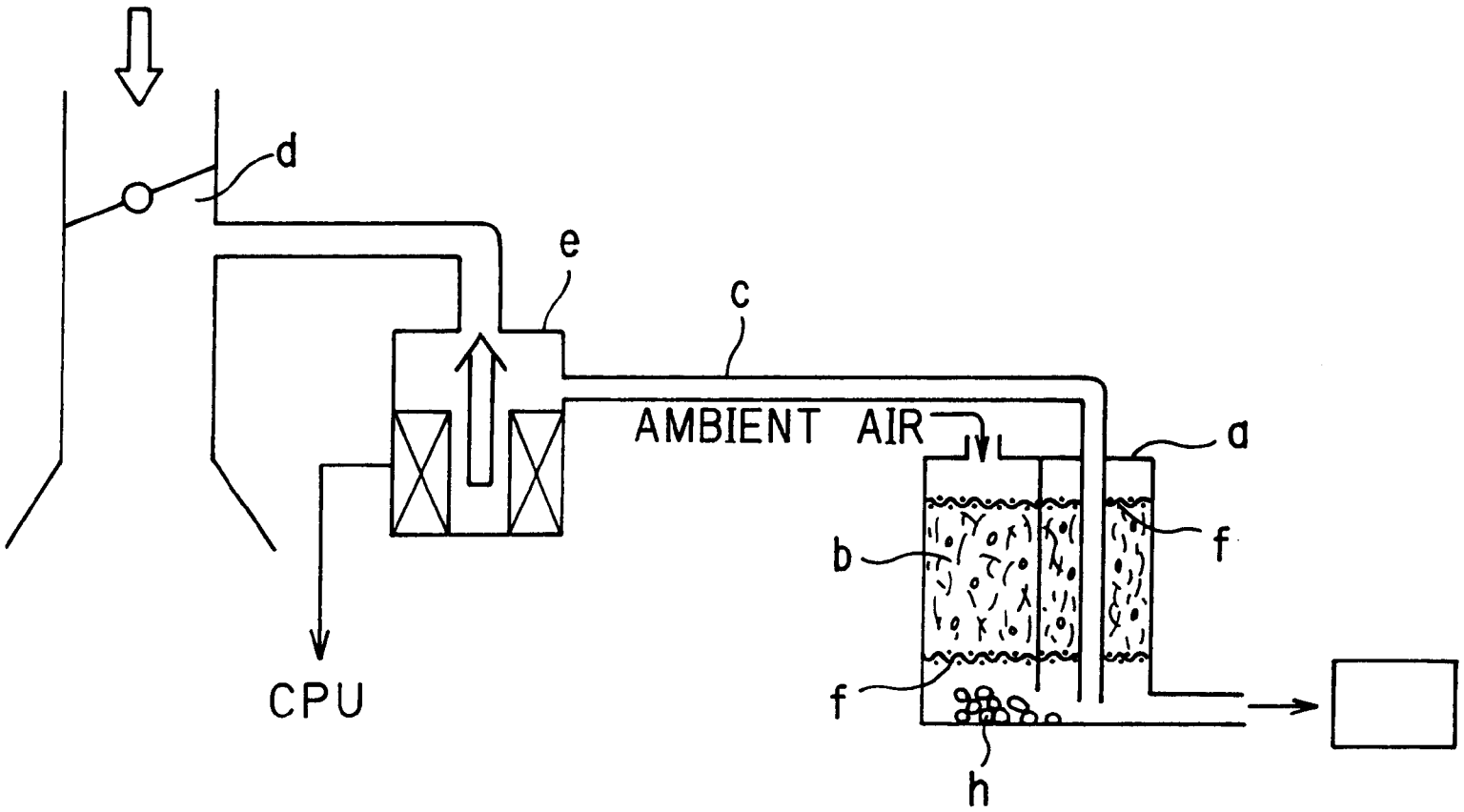
FIG. 13 (PRIOR ART)
FIG. 13 is an explanatory illustration showing one example of a conventional evaporative emission control system in which a bottom type of a canister is employed.
Figure 14:
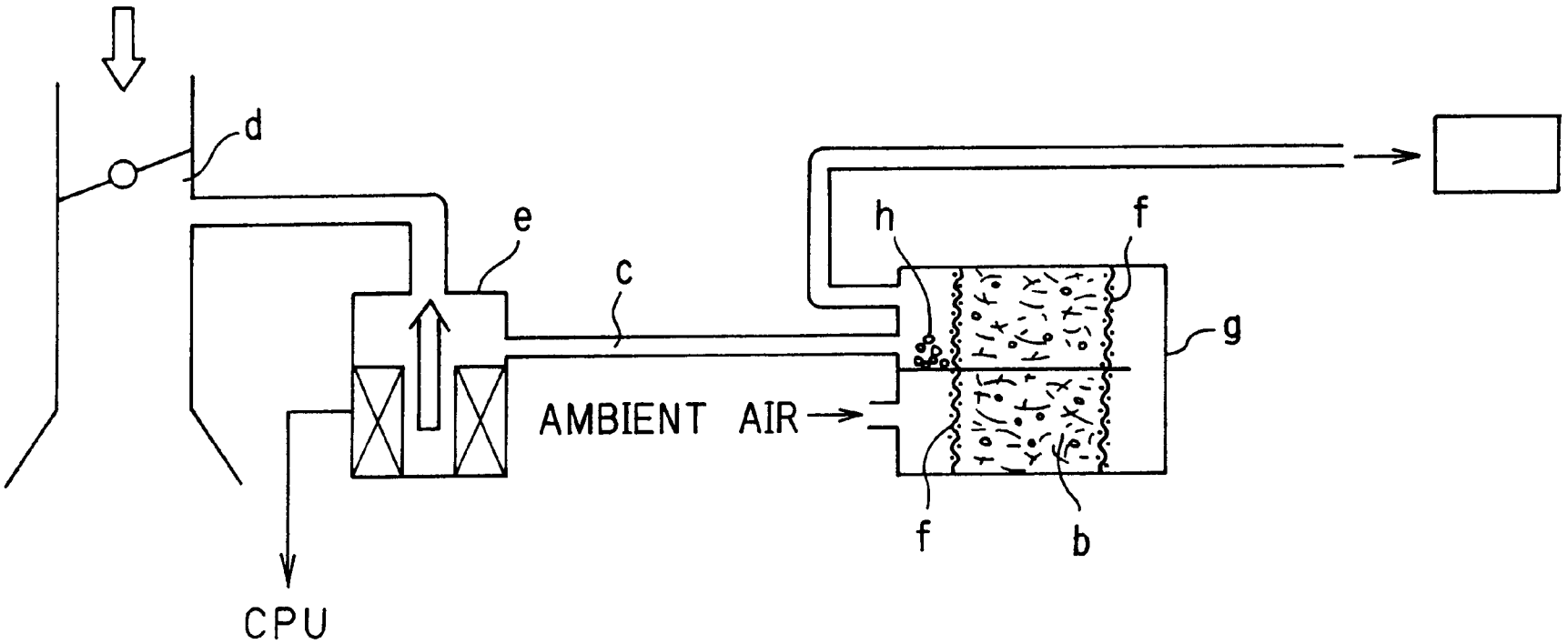
FIG. 14 (PRIOR ART)
FIG. 14 is an explanatory illustration showing another example of a conventional evaporative emission control system in which a vertical type of a canister is employed.
Figure 15:
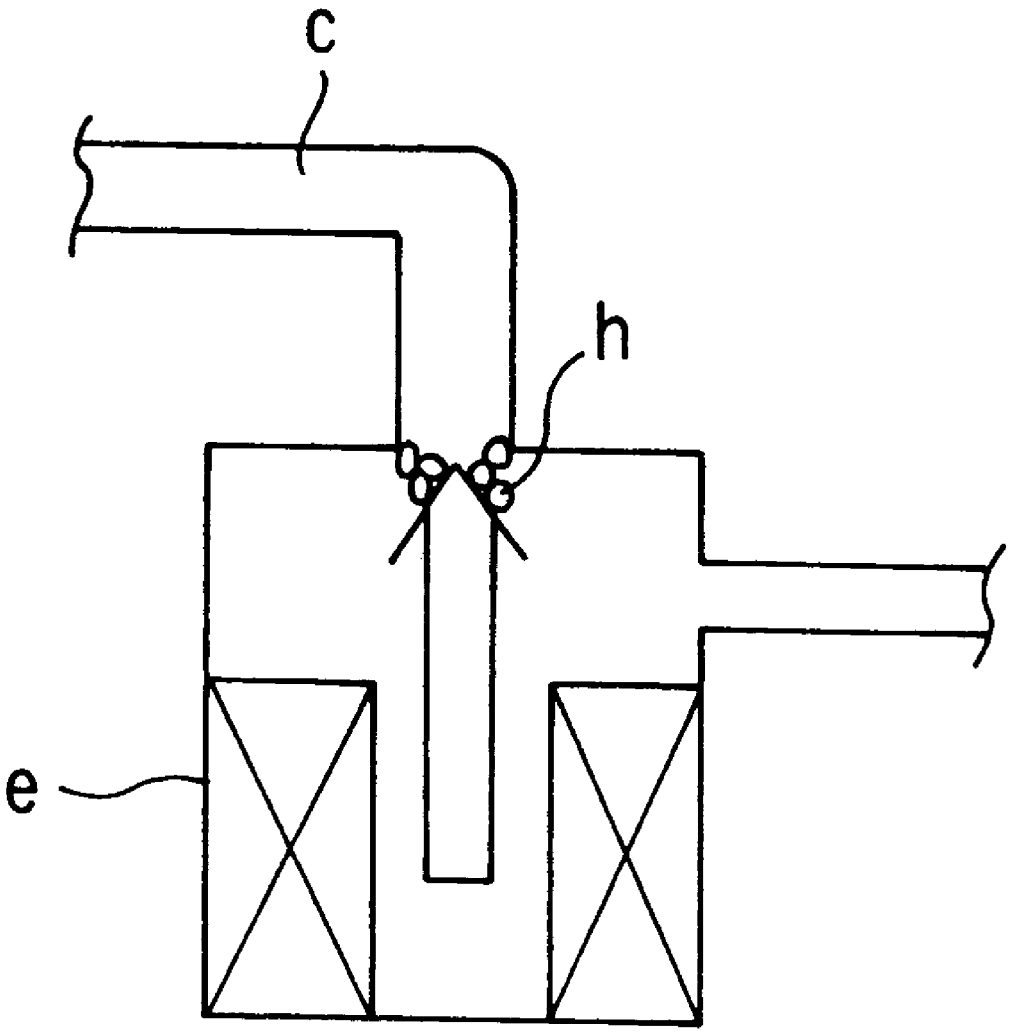
FIG. 15 (PRIOR ART)
FIG. 15 is an explanatory illustration showing an inconvenience of the purge valve as used in the conventional systems of FIGS. 13 and 14.

In the above-described embodiment, a bottom type (i.e., a vertical type) of canister 126 is illustrated. Alternatively, a horizontal type of canister 150 as shown in FIG. 12 may be employed because similar effects of the present invention are provided.

In addition, apart from the above embodiment, the body 136 may be combined integrally with either the canister 126 or the purge valve 130.

As evidenced by the above, the evaporative emission control system pursuant to the present invention is capable of ensuring that the activated carbon particles in the canister are blocked from flowing into the purge valve. As a result, the sealing portion of the purge valve can be prevented from being damaged.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. In an evaporative fuel controller for an internal combustion engine, having a canister disposed between an evaporation passage communicated to the inside of a fuel tank and a purge passage communicated to an intake system of the engine, and a purge valve provided along said purge passage for controlling an amount of evaporative fuel to said intake system in accordance with an operating state of said engine, the improvement comprising: a filler tube having a filler passage formed therein for pouring fuel into said fuel tank; a check valve disposed in said filler tube for closing said filler passage immediately after the supply of fuel to said fuel tank; a refueling vapor control valve disposed on said fuel tank, said control valve communicating with said evaporation passage; a tank-side communication passage for communicating said refueling vapor control valve with said filler passage on the upstream side of said check valve; a first communication passage for communicating said tank-side communication passage and said canister with one another; a first two-way check valve positioned in said first communication passage; a fuel cut valve located on said fuel tank; a second communication passage for communicating said fuel cut valve and said canister with one another; a second two-way check valve disposed in said second communication passage; a third communication passage bypassing said second two-way check valve and communicating with said second communication passage; and a two-way solenoid valve provided in said third communication passage.

2. An evaporative fuel controller as defined in claim 1, wherein said canister is connected to one end of an ambient air-side tube, said tube being formed with an ambient air-side passage, while the other end of said tube is opened into a vehicle body frame member, and wherein said ambient air-side passage is provided with an air cut valve, while an air filter is provided on the air upstream side of said air cut valve.

3. In an evaporative emission control system having a purge valve disposed in an evaporative emission supply passage between a canister and an engine, said canister permitting evaporative emissions from a fuel tank to be absorbed by activated particles in said canister, said purge valve being controlled to open and close for controlling the supply of the evaporative emissions to said engine, the improvement comprising:

a body disposed in said evaporative emission supply passage between said canister and said purge valve, said body housing a plate and a resilient member, in which said plate extends across the flow direction and can be opened and closed in opposition to flow of evaporative emissions through said evaporative emission supply passage, said plate including a filter member permeable by said evaporative emissions, said filter member being capable of collecting said activated particles, whereas said resilient member urges said plate in a closed direction, said resilient member having an urging force such as to permit said plate to be opened by a pressure differential between upstream and downstream sides of said plate when said filter member is clogged with the activated particles; and an activated particle storage chamber provided at a lower portion of said body for storing the activated particles which falls from said filter member when said plate is opened and closed by the aforesaid pressure differential.

4. A system according to claim 3, wherein the storage compartment is formed with a takeoff aperture through which collected particles can be removed.

* * * * *